United States Patent [19]

Boyer

[11] 4,187,983

[45] Feb. 12, 1980

[54] PLURAL COMPONENT-MULTI STATE MIXING AND ENCAPSULATING NOZZLE

[75] Inventor: Harold Boyer, Houston, Tex.

[73] Assignee: National Cellulose Corporation, Houston, Tex.

[21] Appl. No.: 842,433

[22] Filed: Oct. 17, 1977

[51] Int. Cl.[2] ..... B05B 7/08; B05B 7/14

[52] U.S. Cl. ..... 239/9; 239/422

[58] Field of Search ..... 239/418, 419.3, 421–424, 239/427.3, 428, 9

[56] References Cited

U.S. PATENT DOCUMENTS

| | | | |
|---|---|---|---|
| 2,433,463 | 12/1947 | Lampe | 239/422 |
| 2,578,412 | 12/1951 | Fisher | 239/428 X |
| 2,683,625 | 7/1954 | Fisher | 239/422 |
| 2,732,258 | 1/1956 | Fisher | 239/422 X |
| 3,214,103 | 10/1965 | Kempthorne | 239/428 X |
| 3,255,973 | 6/1966 | Crowley | 239/422 |

*Primary Examiner*—Robert W. Saifer

*Attorney, Agent, or Firm*—Fulbright & Jaworski

[57] ABSTRACT

A nozzle suitable for mixing atomized first and second components of a resin exterior to the nozzle and combining the atomized and combined resinous components with a base material such as a fibrous or granular insulation material. The nozzle comprises a front plate and a back plate, the back plate individually receiving under pressure the first component and second component of the resin, a base material and an air supply. The front and back plates are secured in registry to each other so that central passageways in the front and back plates communicate the base material through the nozzle to be exhausted onto a surface. The air supply is communicated through the back plate to a continuous channel on the surface of the back plate in registry with the front plate and the first and second components of the resin are transmitted through the back plate by means of single passageways on either side of the continuous air channel. A pair of continuous channels on the surface of the front plate individually communicate with the passageways for the first and second resinous components. A plurality of air holes on the surface of the front plate in registry with the back plate communicates with the continuous air channel on the back plate. Each of the continuous channels on the front plate contain a plurality of apertures, one plurality leading to a corresponding plurality of atomizer jets on the outside surface of the front plate and the other plurality leading to a second corresponding plurality of jets on the outside surface of the front plate. The air holes in the front plate are drilled at angles such that the air supply communicates with both pluralities of atomizer jets. The first and second components of the resin are therefore individually atomized and combined with a base material exterior to the nozzle.

3 Claims, 4 Drawing Figures

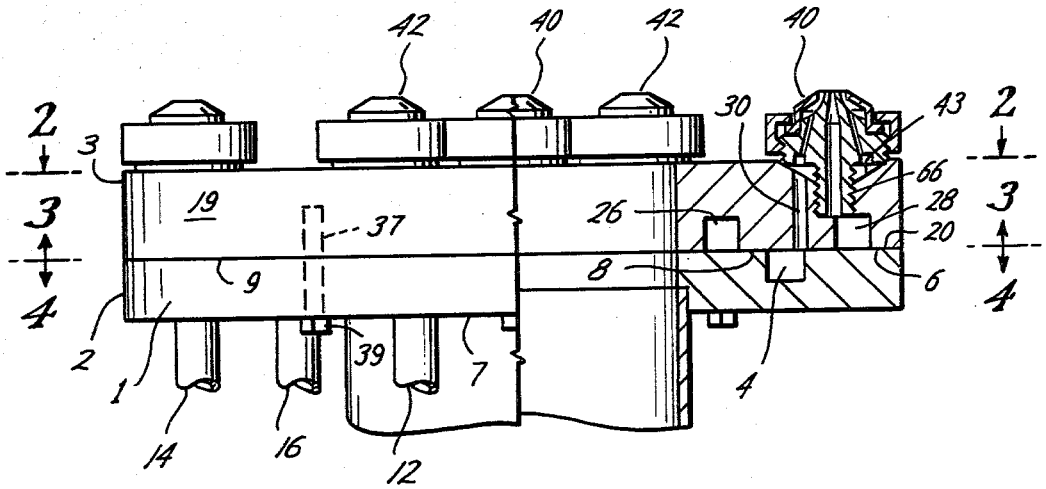
Fig. 1
Fig. 2
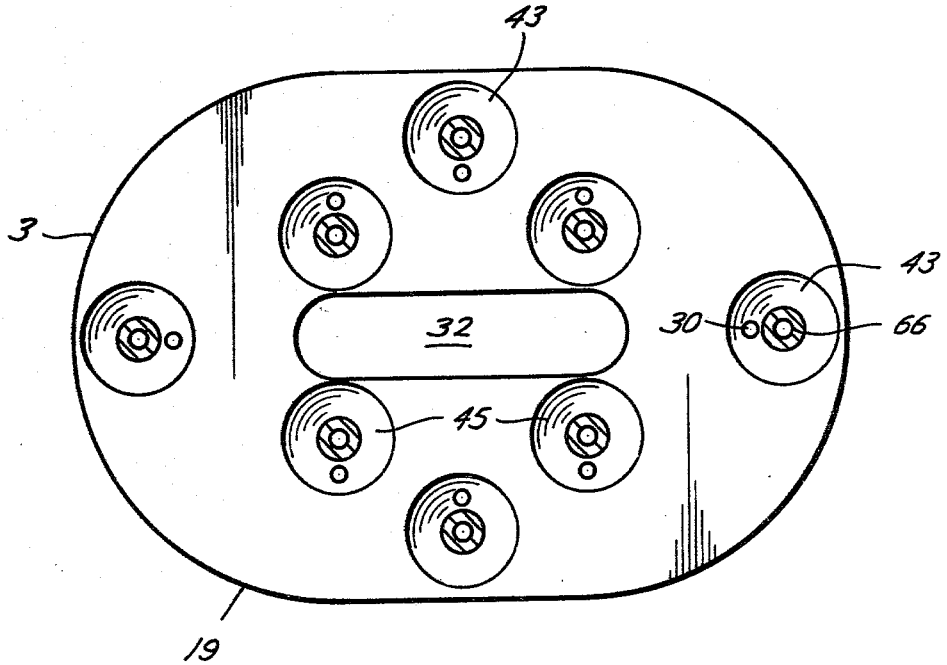

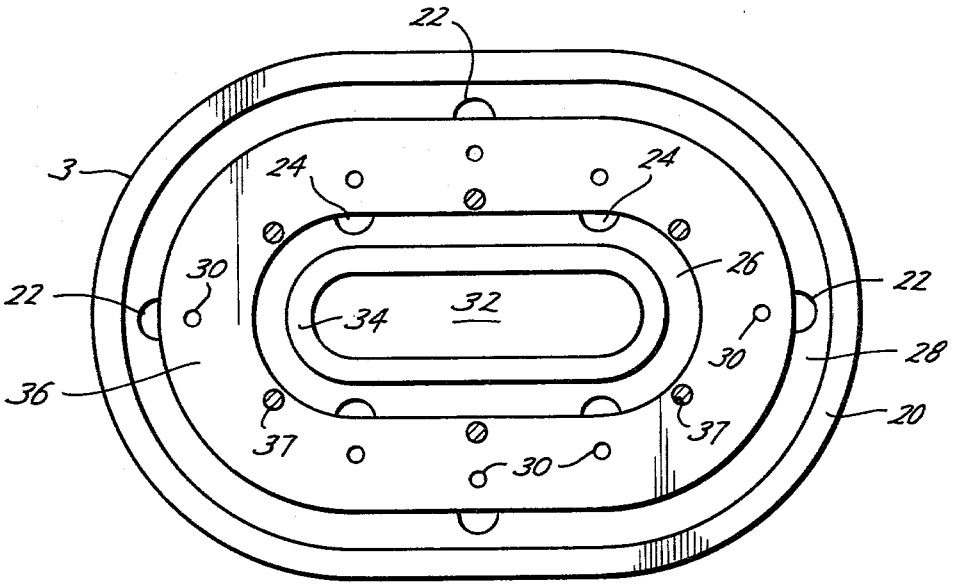
Fig. 3
Fig. 4
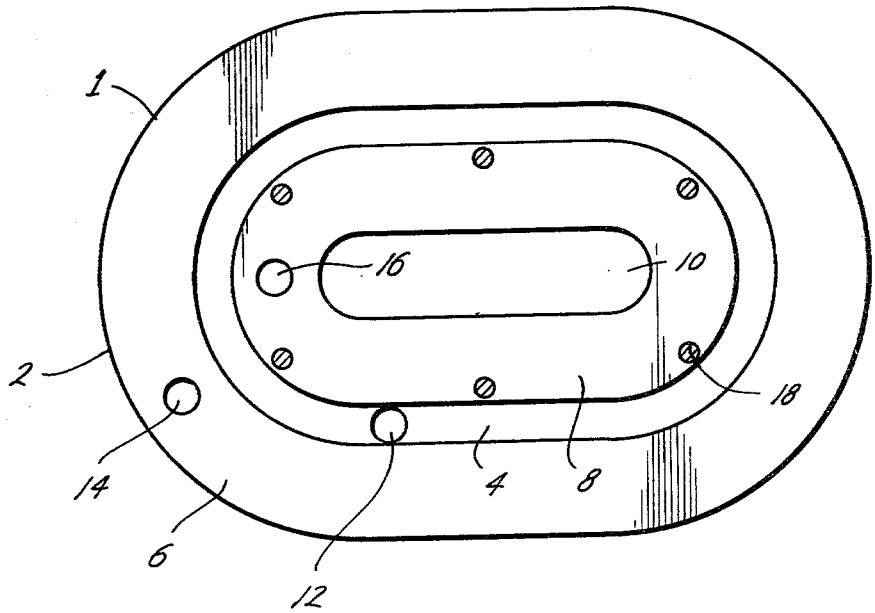

PLURAL COMPONENT-MULTI STATE MIXING AND ENCAPSULATING NOZZLE

STATEMENT OF THE PRIOR ART

Insulating materials and other similar materials are frequently applied by spraying a cohesive material such as a resin either with or onto a base material such as a fiber or a grain such that the mixed resin and the base material adhere to the surface to be insulated. Any number of two component resins are suitable for adhering the base material to a surface, necessitating a mixing at some point of the component "A" and the component "B" in order to produce a cohesive resin.

Numerous spray guns which can spray one or more components are in use. Specific examples of such devices are those found in U.S. Pat. Nos. 3,893,621 to Johnson of July 8, 1975; 3,249,304 to Faro of May 3, 1966; 3,038,750 to Nielsen of June 12, 1962; and 3,606 154 to Tufts of Sept. 20, 1971. While the above noted devices can externally mix a base material with other atomized components, they are less than satisfactory in that the components, for example components A and B are brought into contact within the nozzle. As spraying operations are performed, therefore, components A and B react with each other inside the spray nozzle. Accordingly, a resin or other similar compound steadily sets up inside the nozzle, clogging the exhaust ports and passageways inside the spray gun, thereby reducing the performance of the nozzle or spray gun.

SUMMARY OF THE PRESENT INVENTION

The present device provides a plural componentmulti state mixing and encapsulating nozzle which can eject a base material suitable for insulation through an atomized first component and an atomized second component which are brought into contact with each other and the base material exterior to the nozzle. The nozzle includes a front plate and a back plate, the inside surface of the front plate and the inside surface of the back plate secured and in registry with each other. Individual supplies under pressure of a component A, a component B (comprising, for example, a resinous material), a gas such as air and a base material such as a fibrous or granular insulating material are connected to the outside surface of the back plate. A centrally located passageway through the back plate and a similar passageway through the front plate are substantially aligned and permit the base material to pass therethrough and to be exhausted through the outside surface of the front plate. The air supply passes through a bore in the back plate to a continuous channel on the inside surface of the back plate. Component A communicates through the back plate terminating at the inside surface thereof on one side of the continuous air channel while component B similarly communicates through the back plate terminating in an orifice on the side opposite the orifice for component A. On the inside surface of the front plate, a continuous channel thereon communicates with the component A orifice of the back plate, while a separate continuous channel on the inside surface of the front plate communicates with the component B orifice of the back plate. A plurality of air holes on the inside surface of the front plate lying between the continuous channels for components A and B communicates with the air channel on the back plate. A first plurality and a second plurality of conventional atomizer jets are disposed on the outside of the front plate. Apertures disposed within the component A continuous channel communicate through the front plate to the first plurality of atomizer jets. Apertures disposed within the component B continuous channel communicate through the front plate to the second plurality of conventional jets. The air holes on the inside surface of the front plate communicate through the front plate at alternating angles such that some of the air holes communicate to the conventional jets for component A and the remaining air holes communicate with the conventional jets for component B. Correspondingly, component A is individually atomized by a plurality of jets, as is component B. The atomized components A and B are angled by the jets such that they combine with each other and with the exhausted base material exterior of the nozzle.

It is therefore an object of the present invention to provide a nozzle supplied with individual components of a desired material in which the individual components are individually atomized, and then combined into a mixed plural component material exterior of the nozzle.

It is a further object of the present invention to provide a nozzle which can distribute individually atomized components of a multi-component material onto an exhausted base material such that all components and the base material are mixed externally of the nozzle.

A still further object of the present invention is to provide a nozzle for exteriorly combining the individually atomized components of a binding material with a base material such that a single inlet air supply source individually communicates to the jets for component A and the jets for component B for atomization of the components.

Yet a further object of the present invention is to provide a plural component-multi state mixing and encapsulating nozzle in which a single supply of a component A communicates to a plurality of atomizer jets and a single source of component B likewise communicates to another plurality of atomizer jets.

An even further object of the present invention is to provide a plural component-multi state mixing and encapsulating nozzle having a front and a back plate secured in registry, the front and back plates easily being separated for quick and efficient cleaning thereof.

These and other objects of the present invention will become apparent in light of the specification, the appended drawings and the following claims.

BRIEF DESCRIPTION OF THE DRAWINGS

FIG. 1 is a side elevations view of the nozzle in partial section.

FIG. 2 is a plan sectional view taken along lines 2—2 of FIG. 1.

FIG. 3 is a plan sectional view of the nozzle taken along lines 3—3 of FIG. 1.

FIG. 4 is a plan sectional view of the nozzle taken along lines 4—4 of FIG. 1.

DESCRIPTION OF THE PREFERRED EMBODIMENT

As shown in the drawings the present invention includes a front plate and a back plate, preferably oval shaped, each having an inside surface and an outside surface. The outside surface 7 of the back plate (1) receives individually a supply of component A and component B, for example chemically re-active binders, a supply of gas such as air and a base material powered by a separate gas stream. A fiber orifice 10 communicating substantially centrally through the back plate and a second fiber orifice 32 communicating substantially centrally through the front plate 3 are in basic alignment when the inside of the front plate is secured to and in registry with the inside surface of the back plate. An all driven base material, frequently referred to hereinafter as the fiber, communicates through the aligned fiber orifices 10 and 32 and is exhausted out the front plate 3 onto the surface to be insulated. Component A communicates from the outside surface 7 of the back plate to the inside surface 9 of the back plate 9 through an orifice 14. Similarly, component B communicates from the source to the inside surface of the back plate through an orifice 16. The air supply communicates from the source through the back plate to an air orifice 12 which is disposed within and communicates with a continuous air distribution channel 4. The air channel 4 is substantially equidistant from the fiber orifice 10 and passes between the component A orifice 14 and the component B orifice 16. A flat surface 6 having an inner perimeter coincident with the outer perimeter of the air channel 4 has an outer perimeter 2 which defines the perimeter of the back plate 7 as shown in FIG. 4. A second flat surface 8 has an outer perimeter coincident with the inner perimeter of the air channel 4 and an inner perimeter which defines the margins of the fiber orifice 10. Disposed within the surface 8 are spaced apart bolt holes 18 for mounting the front plate to the back plate.

The outer perimeter 19 of the front plate as shown in FIG. 2 is substantially identical to the outer perimeter 2 of the back plate such that when the front plate is mounted in registry to the back plate, the outer walls of the two plates coincide.

Referring to FIG. 3, a continuous distribution channel 26 for receiving component B is disposed substantially equidistant from the fiber orifice 32 of the front plate. A component A distribution channel 28 is located outwardly of the component B channel 26 on the inside surface of the front plate, and is likewise equally spaced from the fiber orifice 32. A flat surface 20 having an inner perimeter coinciding with the outer perimeter of the component B channel and an outer perimeter defining the outer perimeter 19 of the front plate, sealingly engages part of the flat surface 6 on the inside surface of the back plate when the two plates are in registry. Another flat surface 36 has an inner perimeter coinciding with the outer perimeter of the component B channel 26 and an outer perimeter coincident with the inner perimeter of the component A channel 28, and sealingly engages a portion of the surface 8 on the back plate when the two plates are in registry. Another flat surface 34 having an inner perimeter defining the margins of the fiber orifice 32 and an outer perimeter coinciding with the inner perimeter of the component B distribution channel sealingly engages the innermost part of the surface 8 when the two plates are in registry.

As shown in FIG. 1 a first or outer plurality of spaced apart conventional atomizing jets 40 is secured to a plurality of threaded orifices 43 on the outer surface of the front plate. Similarly, a second or inner plurality of spaced apart conventional atomizing jets 42 is disposed within a plurality of threaded orifices 45 inwardly of the first plurality of jets and outwardly of the fiber orifice 32. Preferably, all the jets are threadably secured to corresponding threaded apertures in the outside surface of the front plate.

Referring again to FIG. 3, the component A channel 28 contains a number of apertures 22 therein equal in number to and communicating with jets comprising the first plurality of jets 40. Similarly, the component B channel 26 has a number of apertures 24 therein equal to and communicating with the second plurality of jets 42 on the outside surface of the front plate. When the two plates are in registry, the component A channel 28 communicates with the component A orifice 14 and the component B channel 26 communicates with the component B orifice 14 such that the supply of component A is carried on the outer or first plurality of jets 40 on the outer surface of the front plate and similarly the supply of component B is carried through the back plate and front plate to the inner or second plurality of jets 42.

In FIG. 3 a number of spaced air orifices 30 are disposed on the surface 36 such that when the two plates are in registry, the air orifices 30 all communicate with the air channel 4 on the back plate. The individual air orifices 30 individually communicate at appropriate angles either to a corresponding outer or inner jet. Preferably, the air orifices 30 are alternatingly inclined so as to provide an optimum mist pattern from the nozzle. Accordingly, in the preferred embodiment, one air orifice 30 is inclined outwardly to communicate with one outer jet, and the next orifice 30 is inclined inwardly through the front plate to communicate with an inner jet. Components A and B therefore are first contacted by the air supply within the corresponding jet and atomized and expelled outwardly of the nozzle. By appropriately arranging the outer jets relative to the inner jets, satisfactory mixing of the atomized component A and the atomized component B occurs.

As the components A and B are atomized and combined externally of the nozzle, components A and B also contact the fiber exhausted through the fiber orifice 32 such that the combined A and B resin and the exhausted fiber form a satisfactory insulating material which adheres to a surface.

In the preferred embodiment, both the front and the back plates are approximately one-half inch thick and oval shaped, having a major axis approximately six and one quarter inches and a minor axis approximately four and one quarter inches. The fiber orifices 10 in the back plate and 32 in the front plate are also ovular, each having a major axis of two and three quarter inches and a minor axis of three quarter inches. The inside surface 19 of the front plate is drilled to receive the atomizing jets 40 and 42 in eight places, four of the jets 40 atomizing the component A and located near the perimeter of the front plate, and four of the jets 42 atomizing the component B disposed inwardly of the outer jets and outwardly of the fiber orifice 32. Preferably, two of the outer jets 40 lie at opposite ends of the major axis of the front plate with the remaining two component A jets disposed opposite one another on the minor axis of the front plate in proximity to the periphery thereof. The four jets 42 atomizing the component B preferably are disposed substantially diagonally to the major axis of the front plate and in juxtaposition to one another. The exterior holes 66 are drilled at approximately a three degree angle inwardly on the outer surface of the front plate. The distribution channels 26 and 28 on the inside surface of the front plate are approximately a quarter inch wide and five sixteenths inch deep. The channel 28 for component A is disposed approximately one eighth inch from the outer rim of the front plate and the channel 26 for component B is disposed approximately one eighth inch from the fiber orifice 32. The surface 36 separating the channels for A and B measures approximately eleven sixteenths inch. Six heliocoil holes 37 are drilled and tapped into the surface 36 which receive the mounting bolts 39 projecting from the outside surface of the back plate through the back plate into the heliocoil holes 37 so that the two plates are sealingly in registry. The air channel 4 in the back plate measures approximately one quarter inch by five sixteenths inch. Accordingly, a metal seal of approximately one eighth inch is disposed between the air channel and the component A channel and the air channel and the component B channel.

The components A and B are externally and properly mixed by controlling their supply with metering valves or pressure regulators. The atomized components A and B in external contact with the exhausted fiber or granules produces the homogeneous mass of any reasonably thickness and composition.

What is claimed is:

1. A plural component multi-state mixing and encapsulating nozzle comprising:

(a) a front plate and a back plate each having an inside surface and an outside surface, said inside surface of the front plate in registry with the inside surface of the back plate;

(b) separate inlet means on the outside surface of the back plate for receiving under pressure a first component, a second component, a base material and a gas;

(c) on the inside surface of the back plate:

(i) a first orifice communicating through the back plate with the inlet means for the first component;

(ii) a second orifice disposed inwardly to the first orifice (i) toward the center of the back plate and communicating through the back plate with the inlet means for the second component;

(iii) a third orifice communicating through the back plate with the gas inlet means;

(iv) a first continuous distribution channel disposed about the center of the back plate, said channel disposed between the first orifice (i) and second orifice (ii) and in communication with the third orifice (iii); and (v) a fourth orifice disposed centrally of orifices (i), (ii), and (iii) in the recess (iv), said fourth orifice communicating through the back plate with the inlet means for the base material;

(d) on the inside surface of the front plate:

(i) a flat outer peripheral surface;

(ii) a second continuous annular distribution channel having an outer perimeter coinciding with the inner perimeter of said flat peripheral surface said channel communicating with the first orifice (c) (i);

(iii) a second surface having an outer perimeter coinciding with the inner perimeter of (d) (ii);

(iv) a third continuous distribution channel having an outer perimeter coindiging with the inner perimeter of (d) (iii) and communicating with the second orifice (c) (ii);

(v) a third surface having an outer perimeter coinciding with the inner perimeter of (d) (iv);

(vi) a centrally disposed orifice bounded by the inner perimeter (d) (v) communicating with and closely conforming to the orifice (c) (v);

(vii) a plurality of orifices disposed within the second surface (d) (iii) and in communication with the first continuous distribution channel (c) (iv);

(e) a means to secure the inside surface of the front plate to the inside surface of the back plate;

(f) on the outside surface of the front plate:

(i) an outer plurality of jet atomizers for atomizing the first component, each jet having a first inlet aperture communicating through the front plate with the channel (d) (ii) and a second inlet aperture communicating through the front plate and one of the orifices (d) (vii) with the channel (c) (iv) on the back plate;

(ii) an inner plurality of jet atomizers for atomizing the second component, each jet having a first inlet aperture communicating through the front plate with the channel (d) (iv) and a second inlet aperture communicating through the front plate and one of the orifices (d) (vii) with the channel (c) (iv) on the back plate; and (iii) a centrally disposed orifice for communicating the base material through the front plate with the orifice (d) (vi) whereby the first and second components under pressure are atomized by the jets (f) (i) and (f) (ii) respectively and mixed externally of the nozzle and the resulting mixture is also applied to the fibrous material externally of the nozzle.

2. A method for mixing externally the plural components of a multi-state mixing and encapsulating nozzle comprising:

(a) supplying a first component, a second component, a base material and a gas supply to the outside surface of a back plate;

(b) passing the first component through the back plate to the inside surface thereof;

(c) passing the second component through the back plate to a surface centrally inward of the surface (b);

(d) communicating the gas supply through the back plate to the inside surface of said back plate;

(e) communicating the gas between the surfaces (b) and (c) by means of a continuous distribution channel recessed into the inside surface of said back plate;

(f) communicating the base material through the back plate by means of a substantially centrally disposed passageway therethrough;

(g) securing a front plate of the nozzle in registry to the back plate thereof;

(h) communicating the first component from the orifice (b) to a second continuous distribution channel on the inside surface of the front plate;

(i) communicating the second component from the orifice (c) to a third continuous distribution channel disposed on the inside surface of the front plate and centrally inwardly of the second channel;

(j) communicating the gas in the first distribution channel (e) to a plurality of apertures disposed between the second distribution channel and the third distribution channel on the inside surface of the front plate;

(k) communicating the first component and the second distribution channel through the front plate to a plurality of atomizer jets secured to the outside surface of the front plate;

(l) communicating the second component and the third distribution channel through the front plate to a second plurality of atomizer jets secured to the outside surface of the front plate; communicating the gas of a portion of the orifices 30 to the first plurality of atomizer jets;

(m) communicating the gas in the remainder of the gas orifices 30 to the second plurality of atomizer jets;

(n) communicating the base material through the passageway in the back plate through a corresponding and aligned passageway in the front plate whereby the atomized first component, the atomized second component and the base material are all brought into contact for the first time and mixed externally of the nozzle.

3. A plural component multi-state mixing and encapsulating nozzle comprising:

(a) a front plate and a back plate each having an inside surface and an outside surface;

(b) a means to secure the inside surface of the front plate in registry to the inside surface of the back plate;

(c) a means on the outside surface of the back plate to receive under pressure: (i) a first component; (ii) a second component; (iii) a base material; and (iv) a gas.

(d) a first plurality of jets on the outside surface of the front plate, each jet having a means at one end for receiving a portion of the gas and the first component, atomizing said first component with said gas and exhausting said atomized first component from the other end of the jet;

(e) a second plurality of jets on the outside surface of the front plate, each jet having a means at one end for receiving the remainder of the gas and the second component, atomizing said second component with said gas and exhausting the atomized first component from the other end of the jet;

(f) a centrally disposed exhaust orifice for exhausting the base material;

(g) for communicating under pressure: (i) for the first component, a first passageway through said back plate terminating in an orifice on the inside surface of said back plate; (ii) for the second component, a second passageway through said back plate terminating in an orifice on the inside surface of said back plate; (iii) for the base material, a substantially centrally disposed passageway through the back plate; and (iv) for the gas, a passageway through the back plate terminating at an inside surface thereof in an orifice disposed within a first continuous distribution channel passing between the first passageway and the second passageway;

(h) means to communicate sealingly: (i) the first component; (ii) the second component; (iii) the base material; and (iv) the gas of (g) to the inside surface of the front plate; and (i) a means to communicate: (i) the first component; (ii) the second component; (iii) the base material; and (iv) the gas of (h) through the front plate so that the first component communicates with the jets (d), the second component with the jets (e), the gas communicates individually with both jets (d) and (e) and the base material communicates with the central exhaust orifice (f) whereby the atomized first component, the atomized second component and exhausted base material are combined exteriorly to the nozzle and the first and second plurality of jets.

* * * * *